US008021173B1

(12) United States Patent
Lin

(10) Patent No.: US 8,021,173 B1
(45) Date of Patent: Sep. 20, 2011

(54) SOCKET COVER WITH A PASSAGE WITH A MIDDLE PORTION SMALLER THAN THE END PORTIONS

(75) Inventor: Hsiu-Te Lin, Taipei Hsien (TW)

(73) Assignee: Gigabyte Technology, Taipei (TW)

( * ) Notice: Subject to any disclaimer, the term of this patent is extended or adjusted under 35 U.S.C. 154(b) by 0 days.

(21) Appl. No.: 12/964,462

(22) Filed: Dec. 9, 2010

(30) Foreign Application Priority Data

Oct. 15, 2010 (TW) ..... 99135174 A

(51) Int. Cl.
*H01R 13/44* (2006.01)
*H01R 13/62* (2006.01)

(52) U.S. Cl. ..... 439/142; 439/367

(58) Field of Classification Search ..... 439/138, 439/142, 367, 371, 372
See application file for complete search history.

(56) References Cited

U.S. PATENT DOCUMENTS

| | | | | |
|---|---|---|---|---|
| 5,547,239 | A * | 8/1996 | Allenbaugh | 292/346 |
| 6,923,686 | B1 * | 8/2005 | Cheng | 439/668 |
| 7,077,706 | B1 * | 7/2006 | Yang | 439/650 |
| 7,500,866 | B2 * | 3/2009 | Gennai et al. | 439/367 |
| 7,704,099 | B1 * | 4/2010 | Hong et al. | 439/620.29 |
| 7,794,246 | B2 * | 9/2010 | Cheng | 439/138 |
| 7,862,353 | B1 * | 1/2011 | Azad et al. | 439/157 |
| 7,896,667 | B2 * | 3/2011 | Qing | 439/142 |
| 2004/0000028 | A1 * | 1/2004 | Kim | 16/230 |
| 2010/0248512 | A1 * | 9/2010 | Hiew et al. | 439/142 |
| 2011/0034064 | A1 * | 2/2011 | Sun | 439/367 |

* cited by examiner

*Primary Examiner* — Chandrika Prasad
(74) *Attorney, Agent, or Firm* — Ming Chun Chou

(57) ABSTRACT

A socket cover includes a body and a base. The base includes a passage with a middle portion and two terminals. The width of the middle portion of the passage is smaller than the width of the two terminals of the passage. The body includes a pin, extruded in a direction parallel with an axis and pivotable about the axis relatively to the base. The pin of the body passes through and slides in the passage. When the pin is abutted against one of the terminals of the passage, the pin lodges in the terminal of the passage, so as to fix the body on the base.

16 Claims, 9 Drawing Sheets

SOCKET COVER WITH A PASSAGE WITH A MIDDLE PORTION SMALLER THAN THE END PORTIONS

CROSS REFERENCE TO RELATED APPLICATIONS

This Application claims priority of Taiwan Patent Application No. 099135174, filed on Oct. 15, 2010, the entirety of which is incorporated by reference herein

BACKGROUND OF THE INVENTION

1. Field of the Invention

The invention relates to a socket cover, and more particularly, to a socket cover operated by jamming mechanism.

2. Description of the Related Art

A socket cover is used for protecting an electric socket or for isolating a cavity. When operating, a user manually opens the socket cover to use equipment behind the socket cover.

Referring to FIG. 1, FIG. 1 depicts an exploded view of the conventional socket cover. Two ends of the shaft 16 of the door 15 are engaged with grooves 26 of the base 25, so that the door 15 is enabled to be pivotable about the base 25. While the door 15 closed, the door 15 and the base 25 are interlocked by a hook 17 and a catch 27. Referring to FIG. 2, FIG. 2 depicts a schematic view of another conventional socket cover. A magnet assembly 23 is mounted inside a base 20. When a door 10 of the socket cover is opened, a magnetic element 13 of the door 10 is magnetically attracted by a magnetic element 233 of the magnet assembly 23 to be fixed in the opened position. Meanwhile, when the door 10 is pivoting on a shaft 22 owing to a force applied by a user in a direction T, the magnetic element 13 of the door 10 is magnetically repelled by a magnetic element 232 of the magnet assembly 23 so that the door 10 is pushed by a magnetic force to slide toward a magnetic element 231. Also, when the door 10 is completely closed, the magnetic element 13 of the door 10 is magnetically attracted by the magnetic element 231 of the magnet assembly 23 so as to be fixed in the closed position.

However, many drawbacks exist in the conventional socket cover mentioned above. First, considering the manufacture efficiency, processes are made more complicated due to the requirement to position the hook and the catch or the magnetic elements on the socket cover. This is a dilemma that magnetic elements are positioned on socket covers of smaller devices as magnetic elements are relatively large. Also, costs are rising due to the requirement that the socket cover need to be fixed at the closed position. Moreover, for the hook and the catch, while volume thereof may be smaller than magnetic elements, the stuck feeling may not be felt by users when the socket cover reaches the complete closure.

BRIEF SUMMARY OF THE INVENTION

For conventional techniques, due to the requirement to position a hook and a catch or magnetic elements, costs are rising and volume of a socket cover may become large. Moreover, the stuck feeling may not be felt by users when the socket cover reaches the complete closure. Thus, the present invention provides a socket cover having a small volume with decreased manufacturing costs. Moreover, the stuck feeling may be felt by users while the user uses the socket cover of the present invention.

The invention provides a socket cover including a body and a base. The base includes a passage with a middle portion and two terminals. The width of the middle portion of the passage is smaller than the width of the two terminals of the passage. The body includes a pin, extruded in a direction parallel with an axis and pivotable about the axis relatively to the base. The pin of the body passes through and slides in the passage. When the pin is abutted against one of the terminals of the passage, the pin lodges in the terminal of the passage, so as to fix the body on the base.

The other object of the invention is to provide a socket cover including a body and a base. The base includes a plurality of passages with a respective middle portion and two terminals. The width of the each middle portion of the passages is smaller than the width of the each terminals of the passage. The body includes a plurality of pins, extruded in a direction parallel with an axis and pivotable about the axis relatively to the base. The pins of the body pass through and slide in the corresponding passages. When the pins are abutted against one of the terminals of the passages, the pins lodge in the corresponding terminals of the passages, so as to fix the body on the base.

Thus, the present invention provides a socket cover, wherein when a user pivots the body of the socket cover, the body is fixed in an open or closed position owing to the jamming mechanism occurred between the pin(s) and the passage(s).

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims To solve the problems of conventional socket covers, the present invention provides a socket cover having a small volume with decreased manufacturing costs. Moreover, while using the socket cover of the present invention, the user may feel a stuck feeling as a result of jamming mechanism.

Figure 1:
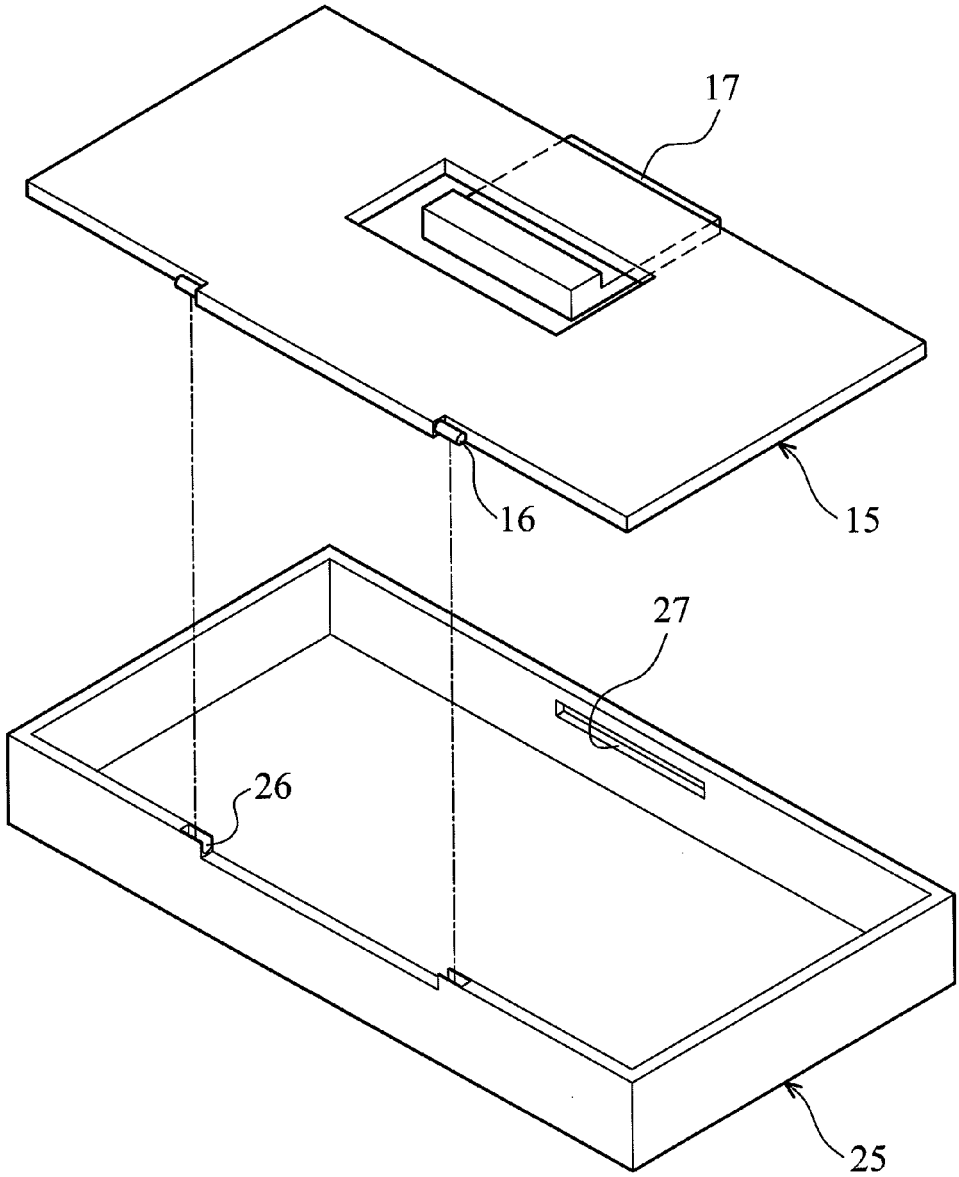
FIG. 1 ( PRIOR ART )
FIG. 1 depicts an explosive view of a conventional socket cover.
Figure 2:
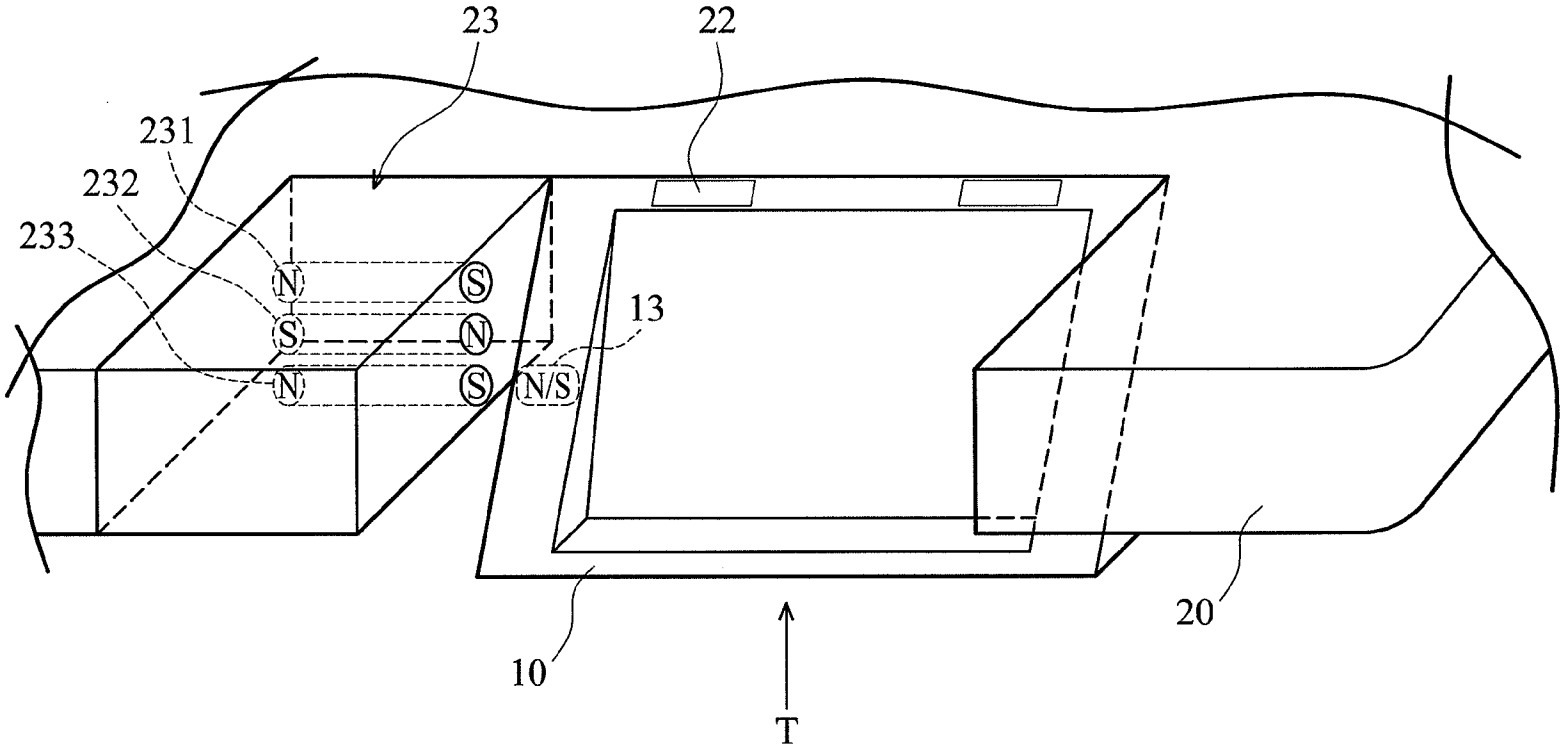
FIG. 2 ( PRIOR ART )
FIG. 2 depicts a schematic view of another conventional socket cover.
Figure 3:
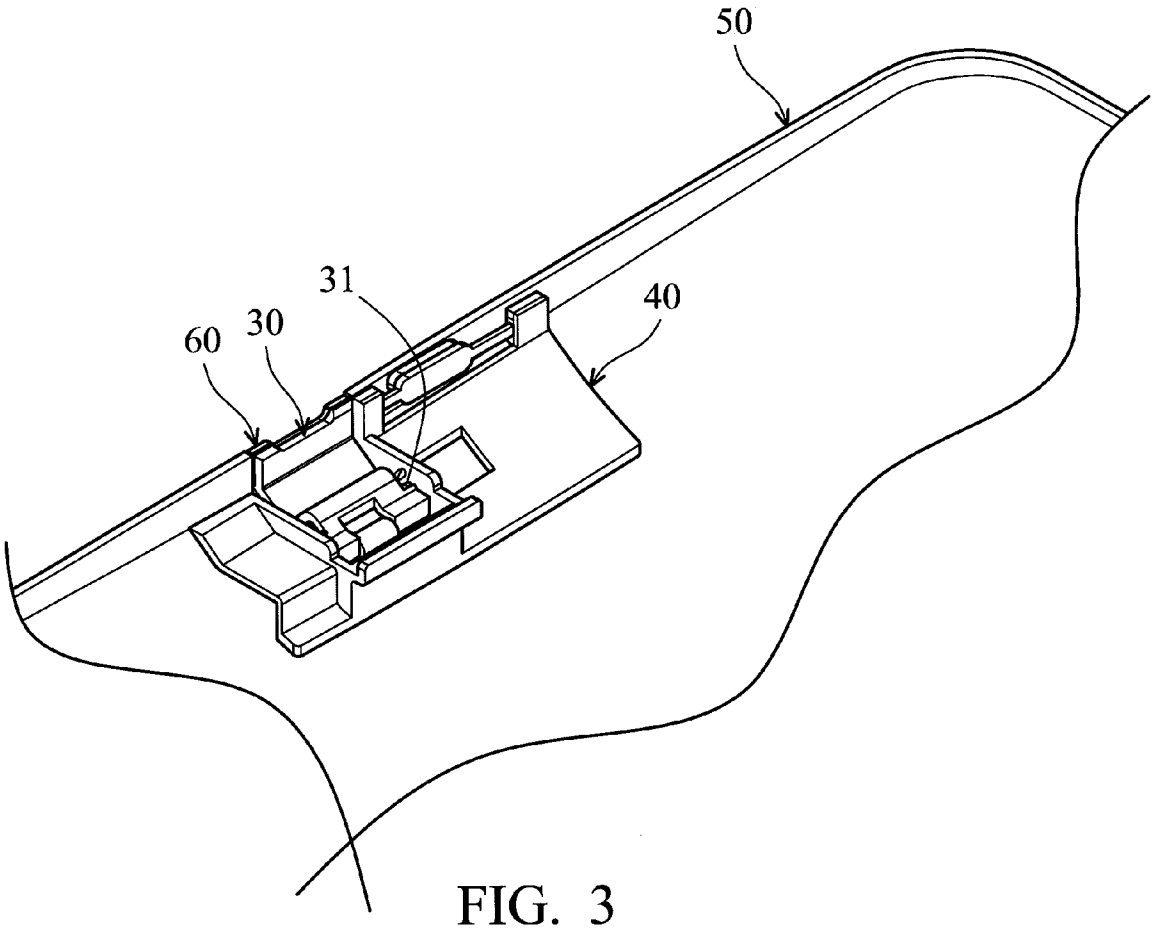
FIG. 3 is a schematic view of the socket cover in accordance with an embodiment of the invention.
Figure 4A:
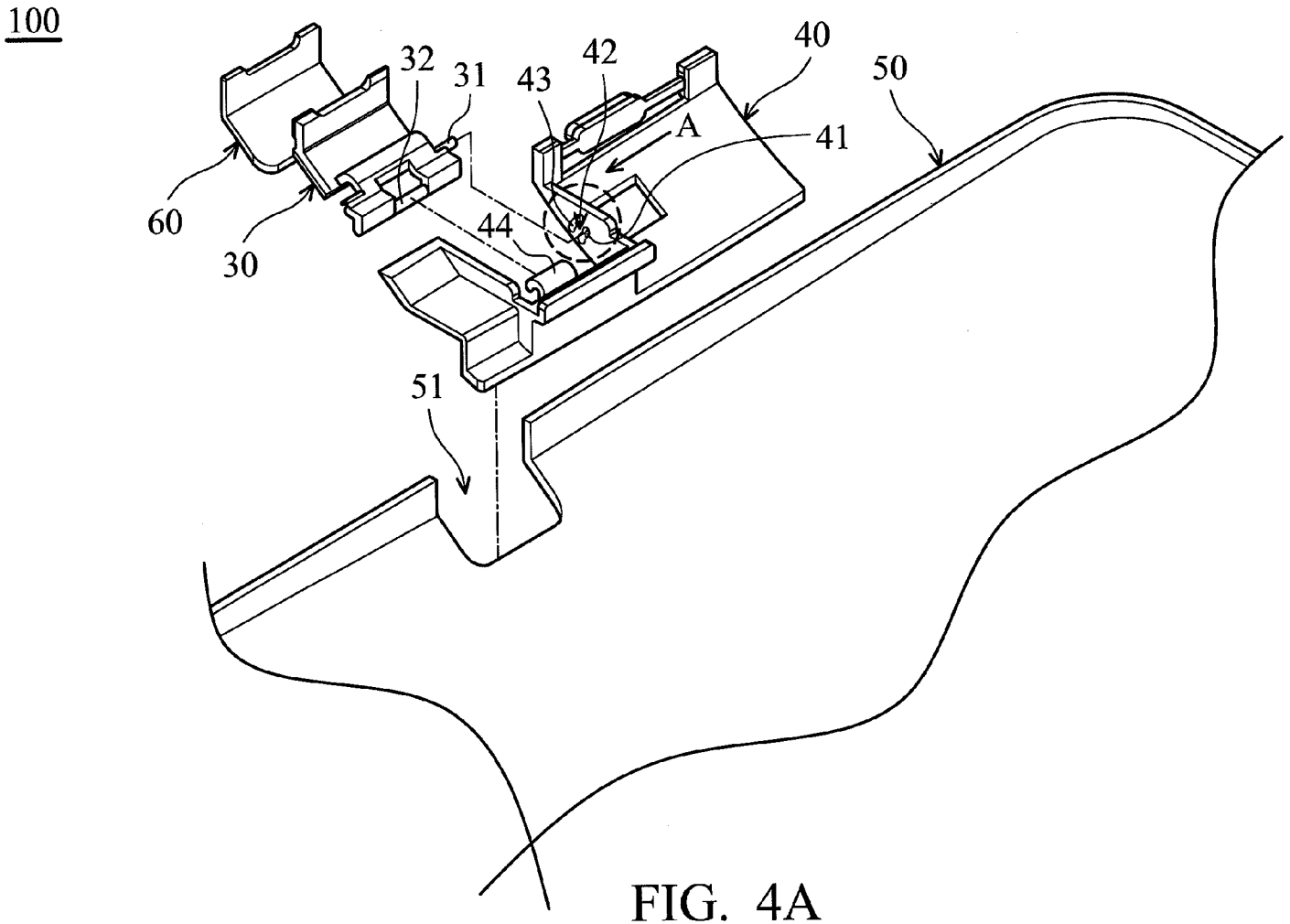
FIG. 4A is an explosive view of the socket cover in accordance with an embodiment of the invention.

Referring to FIG. 3 and FIG. 4A, FIG. 3 is a schematic view of the socket cover 100 in accordance with an embodiment of the invention, and FIG. 4A is an explosive view of the socket cover 100 in accordance with the embodiment of the invention. In this embodiment, the socket cover 100 is disposed on a case 50 of an electronic device, and the socket cover 100 includes a body 30 and a base 40. In FIG. 3 and FIG. 4A, only part of the case 50 is shown, which is indicated in advance.

The case 50 includes a notch 51. The body 30, including a pin 31 and a shaft 32, is disposed corresponding to the notch 51. The base 40, fixed on the case 50, is also disposed corresponding to the notch 51. The base 40, made of plastic materials, includes a passage 41, an opening 43, and a hook 44.

The hook 44, in this embodiment, is substantially C-shaped and includes an opening, and a reference line C is substantially disposed on the axis of the hook 44. The shaft 32 is disposed on one side, near the hook 44, of the body 30. The shaft 32 is engaged in the hook 44 so that the body 30 is pivotable about the reference line C. An axial direction of the pin 31 extends in a direction parallel to the reference line C, and the pin 31 is vertically disposed on the body 30. The passage 41 is aligned with the pin 31. The profile of the passage 41 is an arc, and the reference line C passes the center of the arc. The pin 31 passes through the passage 41 and slides back and forth in the passage 41, thus, the body 30 is relatively rotated about the reference line C.

Furthermore, the socket cover 100 may include a shell 60. The shape and the dimensions of the shell 60 are the same as that of the notch 51, and the shell 60 is attached on the body 30 for ornamental purposes.

Figure 4B:
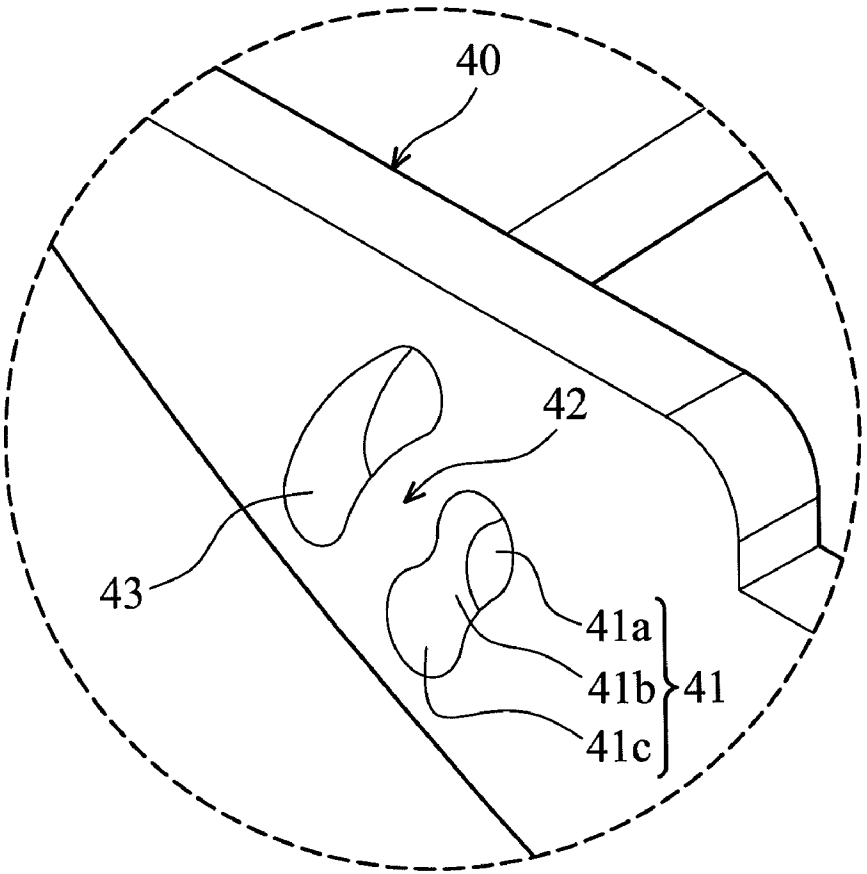
FIG. 4B is a partially magnified view of the socket cover in accordance with an embodiment of the invention.
Figure 5A:
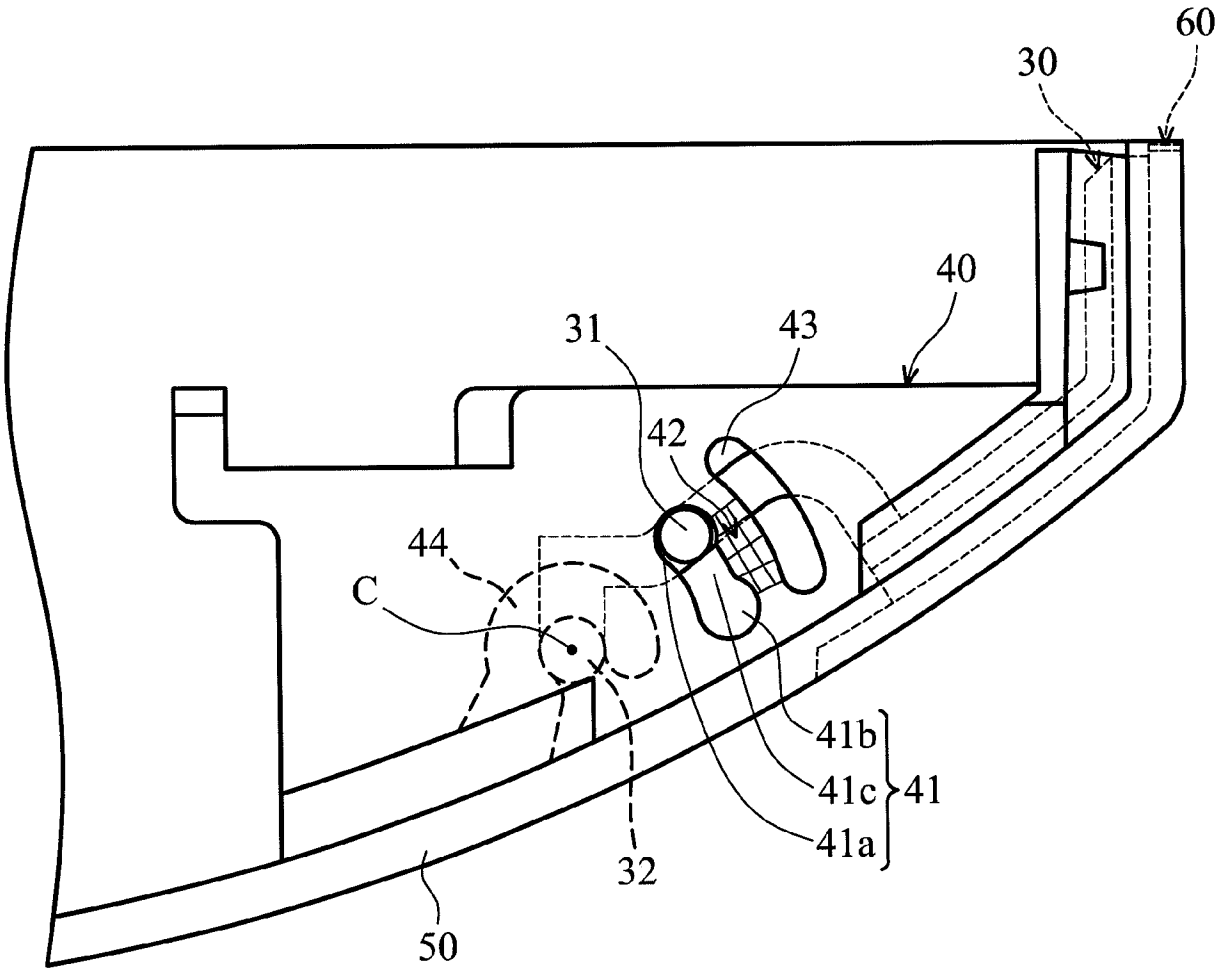
FIG. 5A is a side view in accordance with an embodiment of the invention as the body is closed.

Referring to FIG. 4B and FIG. 5A, FIG. 4B is a partially magnified view of the base 40, and FIG. 5A is a side view of FIG. 4A examined from an A direction, as the body 30 is closed, in accordance with the embodiment of the invention. The width of a middle portion 41*c* of the passage 41 is smaller than the width of terminals 41*a*, 41*b* of the passage 41. Specifically, the width of the middle portion 41*c* of the passage 41 is smaller than the radial dimensions of the pin 31, and the width of the terminals 41*a*, 41*b* of the passage 41 are bigger than the radial dimensions of the pin 31. A connecting line passes both the hook 44 and the passage 41, and the opening 43 is disposed on the connecting line. In other words, the opening 43 is disposed adjacent to the passage 41 in which the opening 43 is more away from the reference line C than the passage 41. A resilient area 42 is disposed between the passage 41 and the opening 43.

Figure 5B:
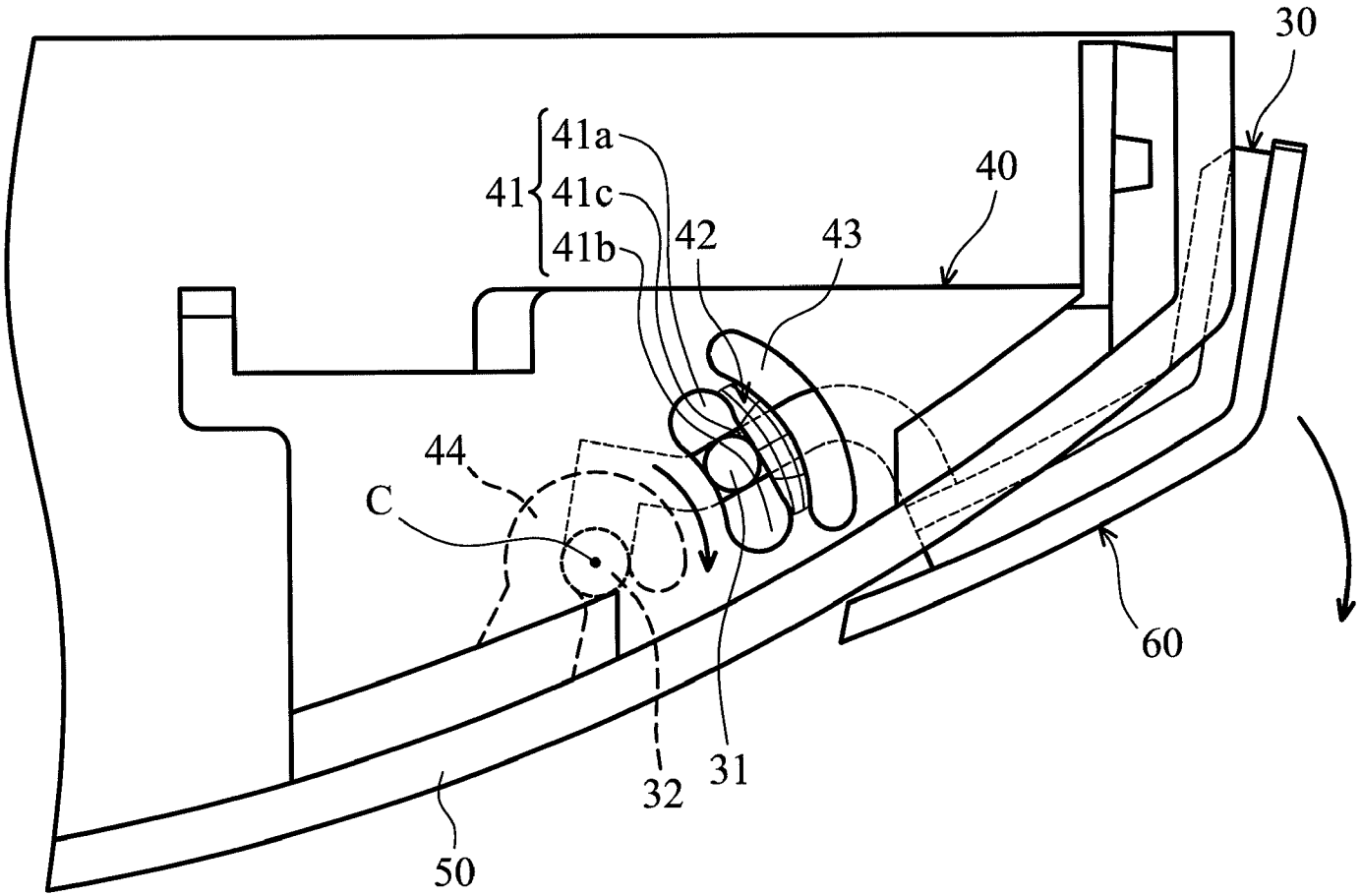
FIG. 5B is a side view in accordance with an embodiment of the invention as the body is being opened/closed.
Figure 5C:
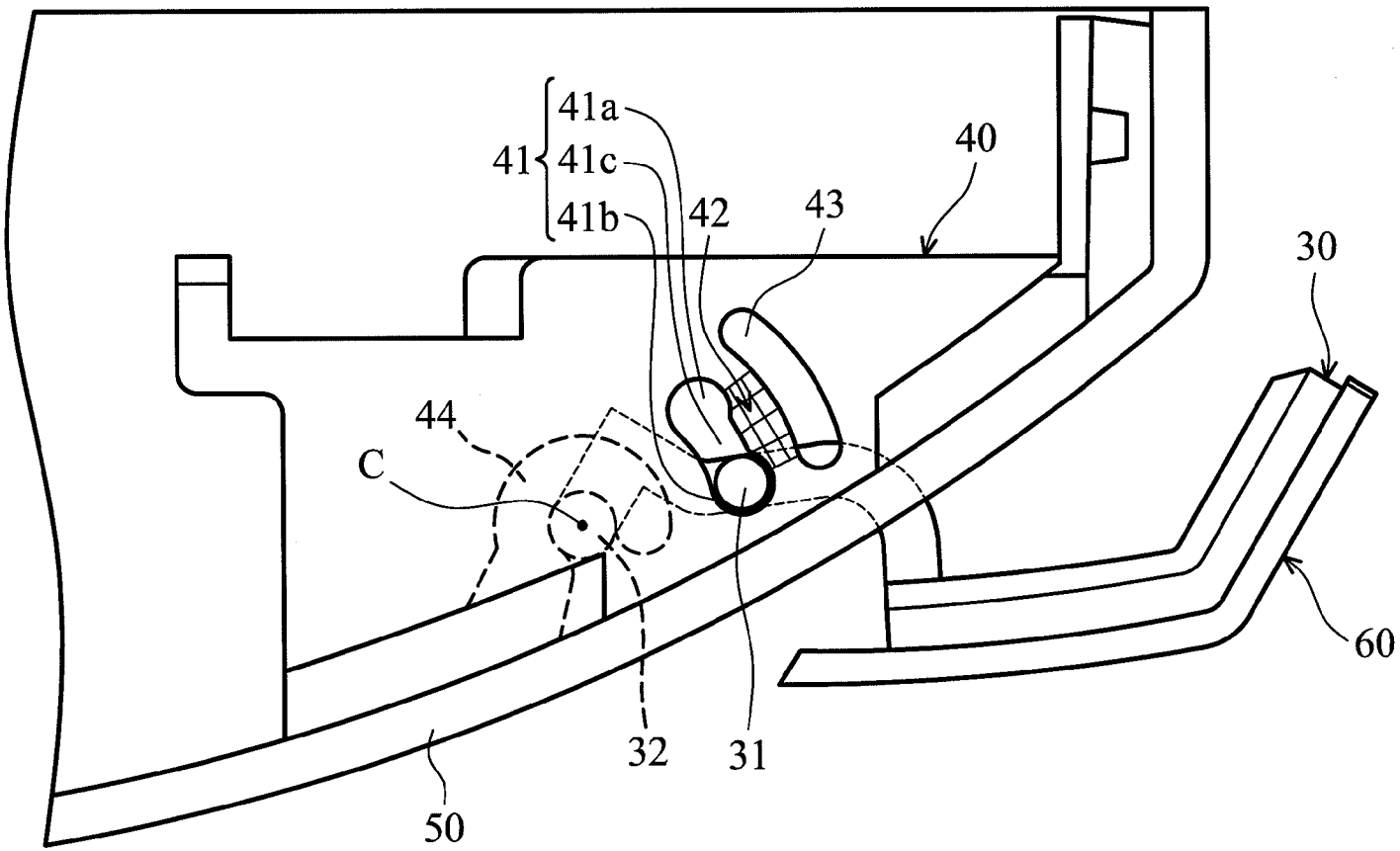
FIG. 5C is a side view in accordance with an embodiment of the invention as the body is opened.

Working principle of the embodiment is described hereafter. Please refer to FIG. 5A, FIG. 5B, and FIG. 5C, wherein FIG. 5A is a side view of FIG. 4A examined from an A direction as the body 30 is closed, in accordance with the embodiment of the invention, FIG. 5B is a side view of FIG. 4A examined from an A direction as the body 30 is being closed/opened in accordance with the embodiment of the invention, and FIG. 5C is a side view of FIG. 4A examined from an A direction as the body 30 is opened in accordance with the embodiment of the invention. In order to clearly describe the operation method, some of the elements are not completely illustrated in FIG. 5A, FIG. 5B, and FIG. 5C, and a plurality of squares are illustrated in the resilient area 42, which is explained in advanced.

When the body 30 is completely closed, the pin 31 is abutted and lodged in one terminal 41*a* of the passage 41. Accordingly, the resilient area 42 is not compressed by stress, and as shown, the squares in the resilient area 42 hold their original shape. When a user opens the body 30 by applying an external force, the pin 31 is dislodged from the terminal 41*a* of the passage 41 and slides to middle portion 41*c* of the passage 41, at the same time the body 30 becomes pivotable about the reference line C; thus, the body 30 is rotated relatively to the base 40. Because the width of the middle portion 41*c* of the passage 41 is smaller than the radial dimensions of the pin 31, jamming mechanism occurs as the pin 31 slides into the middle portion 41*c* of the passage 41. Due to compression, the resilient area 42 is deformed, and the opening 43 is also deformed. Because the base 40 is made of plastic materials, the base 40, deformed in the elastic regime, is resilient. Therefore, when the resilient area 42 is compressed by compression, a reaction force is formed so as to push the pin 31 to slide toward to another terminal 41*b* of the passage 41. When the pin 31 is abutted against and lodged in the terminal 41*b* of the passage 41, the body 30 is in the open position and the resilient area 42 rebounds to its original shape because the compression is removed.

Similarly, when closing the body 30, the user applies an external force on the body 30, and the pin 31 is dislodged from the terminal 41*b* of the passage 41, and slides to the middle portion 41*c* of the passage 41. Then, because jamming mechanism occurs as the pin 31 slides in the middle portion 41*c* of the passage 41, the pin 31 is pushed toward by a reaction force to slide to the another terminal 41*a* of the passage 41. When the pin 31 is abutted against the terminal 41*a* of the passage 41, the pin 31 lodges in the terminal 41*a* of the passage 41, so as to fix the body 30 in the closed position.

The elastic base 40 allows the socket cover 100 of the embodiment to be operated smoothly. In this embodiment, although the base 40 is a plastic element, the material used is not limited. Any elastic material, or resilient material which is capable of reshaping to an original shape after the compression that makes the resilient area 42 deform is removed, can be applied as the base of the invention.

In this embodiment, despite not being shown in the drawings, the opening 43 is disposed adjacent to the passage 41, in which the opening 43 is closer to the reference line C than the passage 41. Alternatively, two openings 43 can be respectively disposed on both sites of the passage 41, one is near the reference line C and another is away from the reference line C. The opening 43 mainly serves to enlarge a deformation area of the base 40 and to increase the elasticity of the base 40 when the resilient area 42 of the base 40 is compressed by stress.

Furthermore, in order to enable the pin 31 to slide back and forth between the terminal 41*a* and terminal 41*b* of the passage 41 smoothly, a lubricant may be applied on both contact surfaces of the pin 31 and the passage 41 to decrease friction coefficient therebetween.

In this embodiment, a reference line C of the hook 44 is utilized for clear description. However, it is not to be limited thereto. An axis, served as a pivoting center of the body 30, is what should be noted as a reference.

Figure 6:
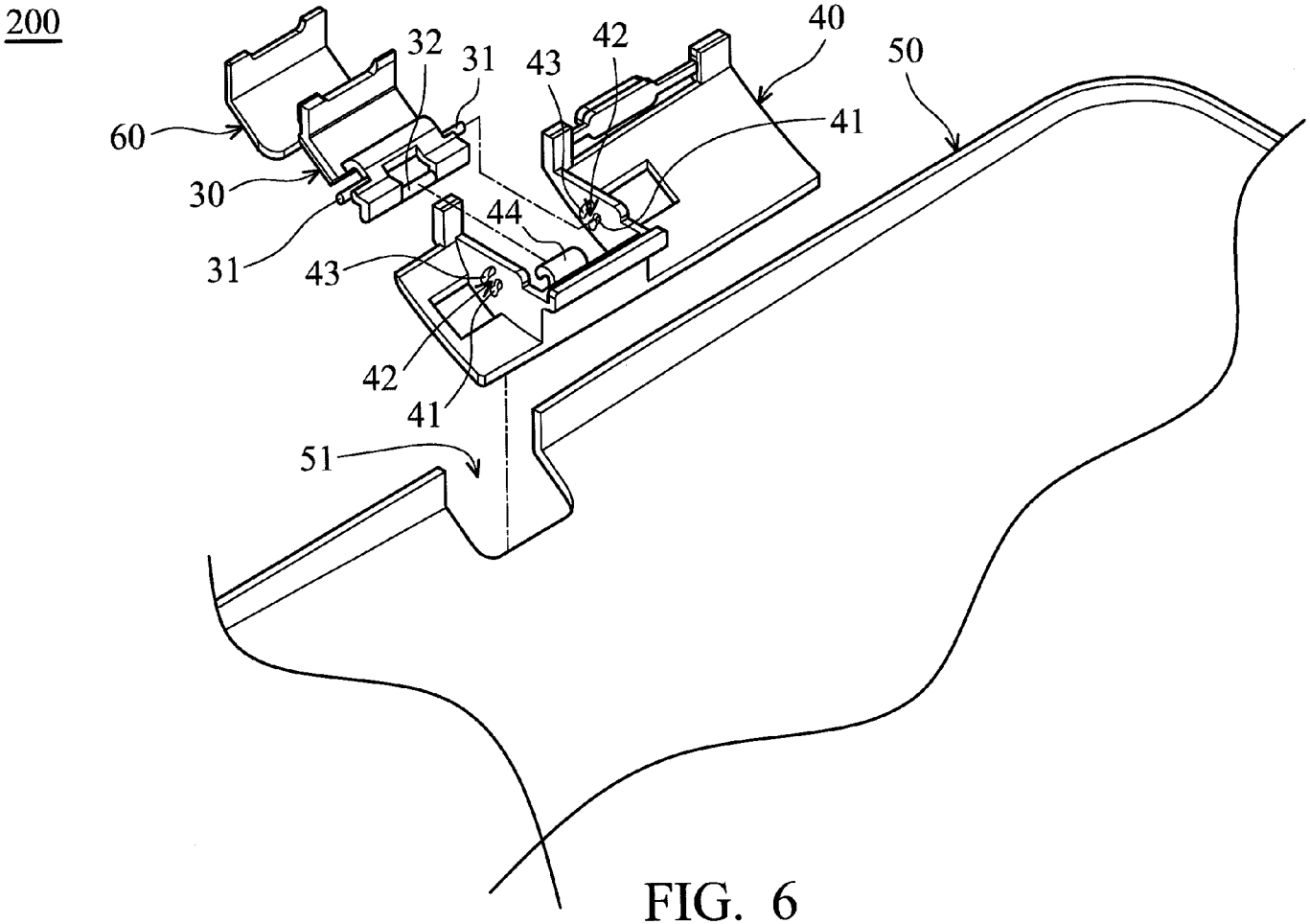
FIG. 6 is an explosive view of the socket cover in accordance with a modified embodiment of the invention.

FIG. 6 shows a socket cover 200 in accordance with a modified embodiment of the invention. In this embodiment, a body 30 includes two pins 31, and a base 40 includes two passages 41, and two opening 43. Two pins 31 are disposed on the two corresponding sides of the body 30 respectively. Two pins 31 of the body 30 pass through and slide in the corresponding passages 41 respectively. It should be noted that, although the pins 31, the passages 41 and the openings 43 are disposed on the two corresponding sides of the body 30, symmetrical layout is not necessary. On the contrary, the disposition can be designed according to application. Additionally, in this embodiment, while not shown in the drawings, two or more than two pins 31 can be respectively disposed on the same side of the body 30. In this case, two or more than two passages 41, aligned to the pins 31, would be disposed on the base 40.

Features of the invention are understood by the above descriptions. The body of the socket cover of the present invention can be fixed while the body is located at an open or closed state by a suitable mating of passage(s) and the pin(s)

and without using any connecting element (i.e. magnetic elements or interlocking elements). Also, a stuck feeling can be felt by the user owing to jamming mechanism occurs between the pin(s) and the passage(s).

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A socket cover, comprising:

a base, comprising a passage with a middle portion and two terminals, the width of the middle portion of the passage being smaller than the width of the two terminals of the passage; and a body, comprising a pin and pivotable about an axis to be rotated relatively to the base, the pin extruded in a direction parallel with the axis, and the pin passed through and slid in the passage;

wherein, when the pin is abutted against one of the terminals, the pin lodges in the terminal to fix the body on the base.

2. The socket cover as claimed in claim 1, wherein the base has a hook and the body has a shaft engaged in the hook, and the combination of the shaft and the hook enables the body to be pivotable about a reference line of the hook.

3. The socket cover as claimed in claim 2, wherein the pin is extended axially in a direction parallel to the reference line of the hook, and the pin is vertically disposed on the base.

4. The socket cover as claimed in claim 1, wherein the base is made of elastic materials.

5. The socket cover as claimed in claim 4, wherein the base further has an opening, disposed on a connecting line passing both the hook and the passage, to enlarge a deformation area of the base and to increase the elasticity of the base.

6. The socket cover as claimed in claim 1, wherein the width of the middle portion of the passage is smaller than the radial dimensions of the pin.

7. The socket cover as claimed in claim 1, further comprising a lubricant, applied on both contacting surfaces of the pin and the passage to decrease friction coefficient between the contacting surfaces of the pin and the surface of the passage.

8. The socket cover as claimed in claim 1, further comprising a shell attached on the body.

9. A socket cover, comprising:

a base, comprising a plurality of passages with a respective middle portion and two terminals, the width of the each middle portion of the passages being smaller than the width of the each terminals of the passages; and a body, comprising a plurality of pins and pivotable about an axis to be rotated relatively to the base, the pins extruded in a direction parallel with the axis, and the pins passed through and slid in the corresponding passages, wherein when the pins are abutted against one of the corresponding terminals, the pins lodge in the corresponding terminals to fix the body on the base.

10. The socket cover as claimed in claim 9, wherein the width of the middle portion of each of the passage is smaller than the radial dimensions of each of the pins.

11. The socket cover as claimed in claim 9, wherein the base has a hook and the body has a shaft engaged in the hook, and the combination of the shaft and the hook enables the body to be pivotable about a reference line of the hook.

12. The socket cover as claimed in claim 11, wherein the pin is extended axially in a direction parallel to the reference line of the hook, and the pin is vertically disposed on the base.

13. The socket cover as claimed in claim 9, wherein the base is made of elastic materials.

14. The socket cover as claimed in claim 13, wherein the base further has an opening, disposed on a connecting line passing both the hook and the passage, to enlarge a deformation area of the base and to increase the elasticity of the base.

15. The socket cover as claimed in claim 9, further comprising a lubricant, applied on both contacting surfaces of the pin and the passage to decrease friction coefficient between the contacting surfaces of the pin and the surface of the passage.

16. The socket cover as claimed in claim 9, further comprising a shell attached on the body.

* * * * *